US005573221A

United States Patent [19]

Reeves

[11] Patent Number: 5,573,221

[45] Date of Patent: Nov. 12, 1996

[54] APPARATUS FOR SUPPORTING A DEPTH FINDING TRANSDUCER FOR ROTATION INDEPENDENT OF A TROLLING MOTOR

[76] Inventor: Stephen W. Reeves, 34550 Clinton Allen Rd., Denham Springs, La. 70726

[21] Appl. No.: 219,079

[22] Filed: Mar. 28, 1994

[51] Int. Cl.[6] ..... F16M 11/32

[52] U.S. Cl. ..... 248/640; 367/173; 440/6

[58] Field of Search ..... 248/640, 641, 248/642; 367/173, 165; 440/6, 900

[56] References Cited

U.S. PATENT DOCUMENTS

| | | | |
|---|---|---|---|
| 4,926,399 | 5/1990 | Hickman | 248/291 X |
| 4,979,153 | 12/1990 | Terry | 367/173 X |
| 4,982,924 | 1/1991 | Havins | 248/288.5 |
| 5,277,630 | 1/1994 | Clark | 440/6 |

*Primary Examiner*—Ramon O. Ramirez

[57] ABSTRACT

An apparatus for mounting on a trolling motor and for supporting a depth finding transducer for independent rotation comprising a bracket having an elongated end plate with an upper end and a lower end, the bracket having a horizontal upper plate secured at right angles adjacent to the upper end of the end plate and a horizontal lower plate secured at a right angle adjacent to the lower end of the end plate; a collar secured to the end of each horizontal plate remote from the end plate for mounting on a trolling motor; an aperture extending through each of the horizontal plates intermediate its collar and the end plate; and a rod extending through the apertures with a handle adjacent to its upper end for rotating the rod and a depth finding transducer at its lower end adapted to be repositioned with the rotation of the rod independent of movement of the bracket and motor.

5 Claims, 4 Drawing Sheets

APPARATUS FOR SUPPORTING A DEPTH FINDING TRANSDUCER FOR ROTATION INDEPENDENT OF A TROLLING MOTOR

BACKGROUND OF THE INVENTION

1. Field of the Invention

The present invention relates to an apparatus for supporting a depth finding transducer for rotation independent of a trolling motor and more particularly pertains to supporting a depth finder on a trolling motor while allowing for independent movement of the motor and the depth finder.

2. Description of the Prior Art

The use of outboard and trolling motors, depth finders and brackets therefor is known in the prior art. More specifically, outboard and trolling motors, depth finders and brackets heretofore devised and utilized for the purpose of concurrently repositioning motors and transducers for depth finding are known to consist basically of familiar, expected and obvious structural configurations, notwithstanding the myriad of designs encompassed by the crowded prior art which have been developed for the fulfillment of countless objectives and requirements.

By way of example, Havins U.S. Pat. No. 4,982,924 discloses a mounting apparatus for sonar transducers.

Hickman U.S. Pat. No. 4,926,399 discloses a transducer mounting system.

Wiegner U.S. Pat. No. 4,485,462 discloses a transducer mounting apparatus.

Wingate U.S. Pat. No. 4,282,590 discloses an adjustable position sonar transducer depth finder.

Stefek U.S. Pat. No. 3,811,310 discloses an apparatus for turning pipes between rolling passes.

In this respect, the apparatus for supporting a depth finding transducer for rotation independent of a trolling motor according to the present invention substantially departs from the conventional concepts and designs of the prior art, and in so doing provides an apparatus primarily developed for the purpose of supporting a depth finder on a trolling motor while allowing for independent movement of the motor and the depth finder transducer.

Therefore, it can be appreciated that there exists a continuing need for new and improved apparatuses for supporting a depth finding transducer for rotation independent of a trolling motor which can be used for supporting a depth finder on a trolling motor while allowing for independent movement of the motor and the depth finder transducer. In this regard, the present invention substantially fulfills this need.

SUMMARY OF THE INVENTION

In view of the foregoing disadvantages inherent in the known types of trolling motors, depth finders and brackets therefor now present in the prior art, the present invention provides an improved apparatus for supporting a depth finding transducer for rotation independent of a trolling motor. As such, the general purpose of the present invention, which will be described subsequently in greater detail, is to provide a new and improved apparatus for supporting a depth finding transducer for rotation independent of a trolling motor and method which has all the advantages of the prior art and none of the disadvantages.

To attain this, the present invention essentially comprises a new and improved apparatus for supporting a depth finding transducer for rotation independent of a trolling motor comprising, in combination, a bracket adapted to be secured to the front end of a boat, the bracket having a vertically disposal elongated end plate with an upper end positionable above the water and a lower end positionable beneath the water, the bracket having a horizontal upper plate secured at right angles from the upper end of the end plate, a horizontal lower plate secured at a right angle from the lower end of the end plate and a horizontal intermediate plate secured at a right angle from an intermediate position of the end plate; a collar secured to the end of each horizontal plate remote from the end plate for mounting on a trolling motor shaft; an aperture extending through each of the horizontal plates intermediate its collar and the end plate; a rod extending through the apertures with a handle at its upper end for rotating the rod and a depth finding transducer at its lower end adapted to be repositioned with the rotation of the rod independent of movement of the trolling motor shaft; bearing members coupled between the rod and the apertures to preclude axial movement of the rod while allowing rotation therebetween; and a washer secured to the upper surface of the upper horizontal plate with upstanding hemispherical projections oriented in a circumferential array and with a cooperable spring-urged resilient finger secured to the rod to effect a relative coupling between the rod and the upper horizontal plate to abate inadvertent rotation of the rod with respect to the washer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for supporting a depth finding transducer for rotation independent of a trolling motor which has all the advantages of the prior art outboard motors, depth finders and brackets therefor and none of the disadvantages.

It is another object of the present invention to provide a new and improved apparatus for supporting a depth finding transducer for rotation independent of a trolling motor which may be easily and efficiently manufactured and marketed.

It is a further object of the present invention to provide a new and improved apparatus for supporting a depth finding transducer for rotation independent of a trolling motor which is of a durable and reliable construction.

An even further object of the present invention is to provide a new and improved apparatus for supporting a depth finding transducer for rotation independent of a trolling motor which is susceptible of a low cost of manufacture with regard to both materials and labor, and which accordingly is then susceptible of low prices of sale to the consuming public, thereby making such outboard motors, depth finders and brackets therefor economically available to the buying public.

Still yet another object of the present invention is to provide a new and improved apparatus for supporting a depth finding transducer for rotation independent of a trolling motor which provides in the apparatuses and methods of the prior art some of the advantages thereof, while simultaneously overcoming some of the disadvantages normally associated therewith.

Still another object of the present invention is to support a depth finder on a trolling motor while allowing for independent movement of the motor and the depth finder transducer.

An apparatus for mounting on a trolling motor and for supporting a depth finding transducer for independent rotation comprising a bracket having an elongated end plate with an upper end and a lower end, the bracket having a horizontal upper plate secured at right angles adjacent to the upper end of the end plate and a horizontal lower plate secured at a right angle adjacent to the lower end of the end plate; a collar secured to the end of each horizontal plate remote from the end plate for mounting on to a trolling motor; an aperture extending through each of the horizontal plates intermediate its collar and the end plate; and a rod extending through the apertures with a handle adjacent to its upper end for rotating the rod and a depth finding transducer at its lower end adapted to be repositioned with the rotation of the rod independent of movement of the bracket and motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
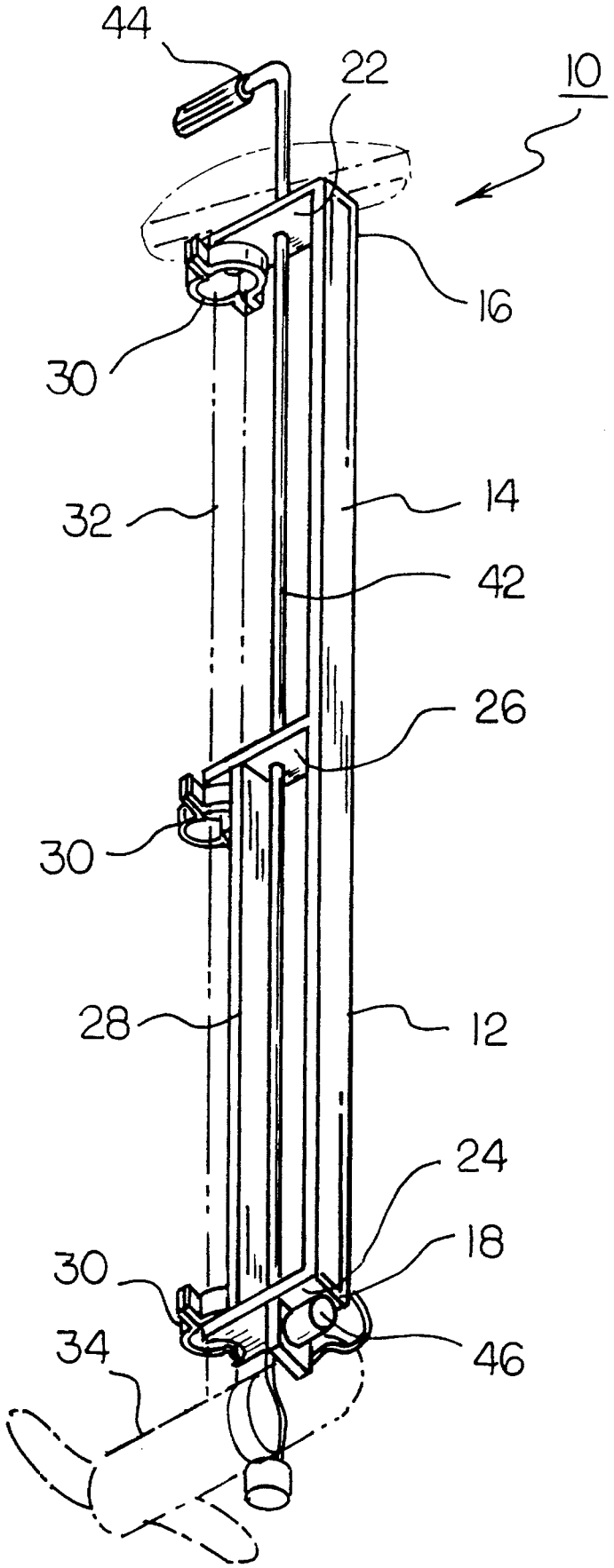
FIG. 1 is a perspective illustration of the new and improved apparatus for supporting a depth finding transducer for rotation independent of a trolling motor constructed in accordance with the principles of the present invention.
Figure 2:
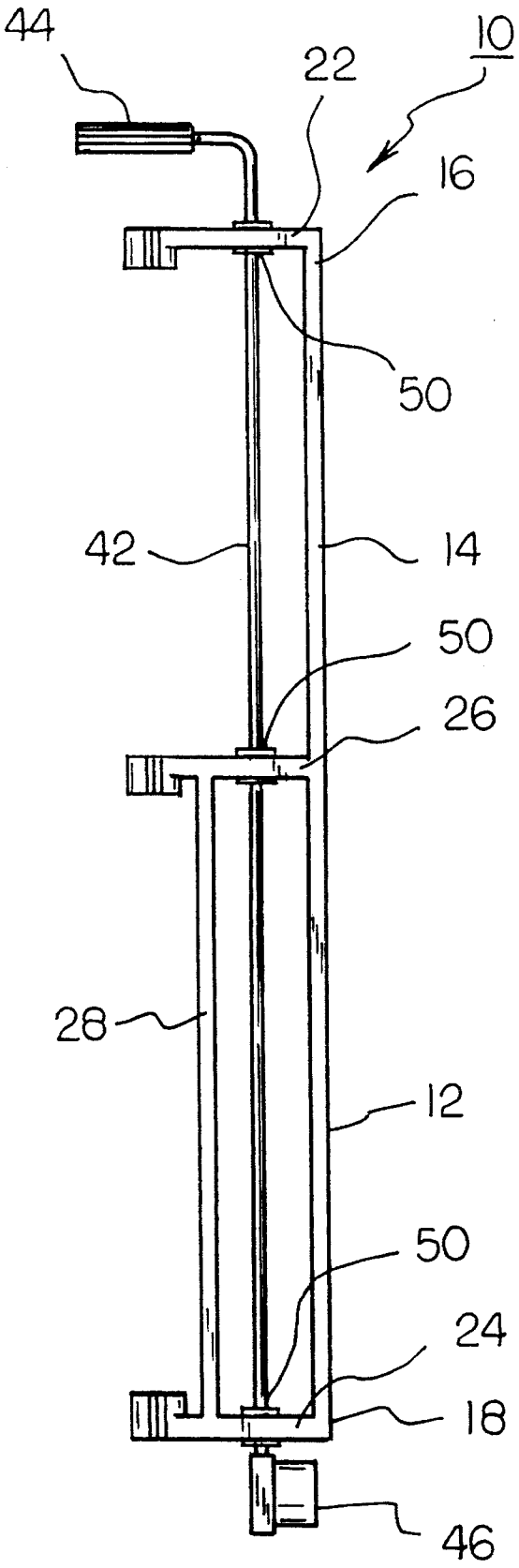
FIG. 2 is a side elevational view of the apparatus as illustrated in FIG. 1.
Figure 3:
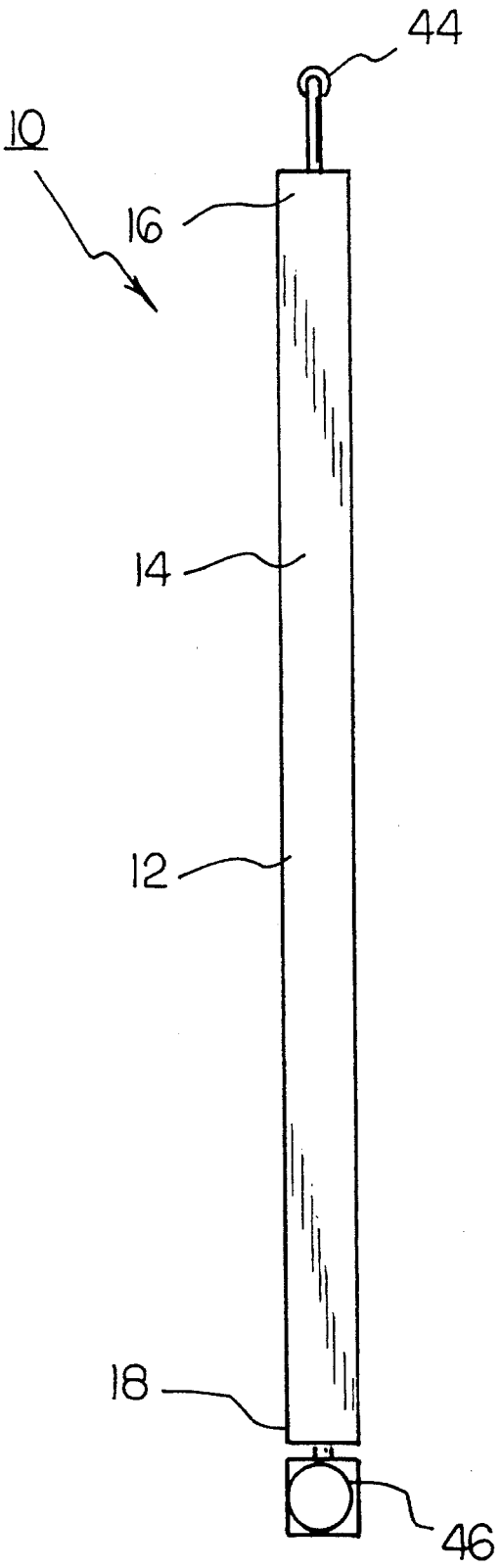
FIG. 3 is a front elevational view of the apparatus shown in FIGS. 1 and 2.
Figure 4:
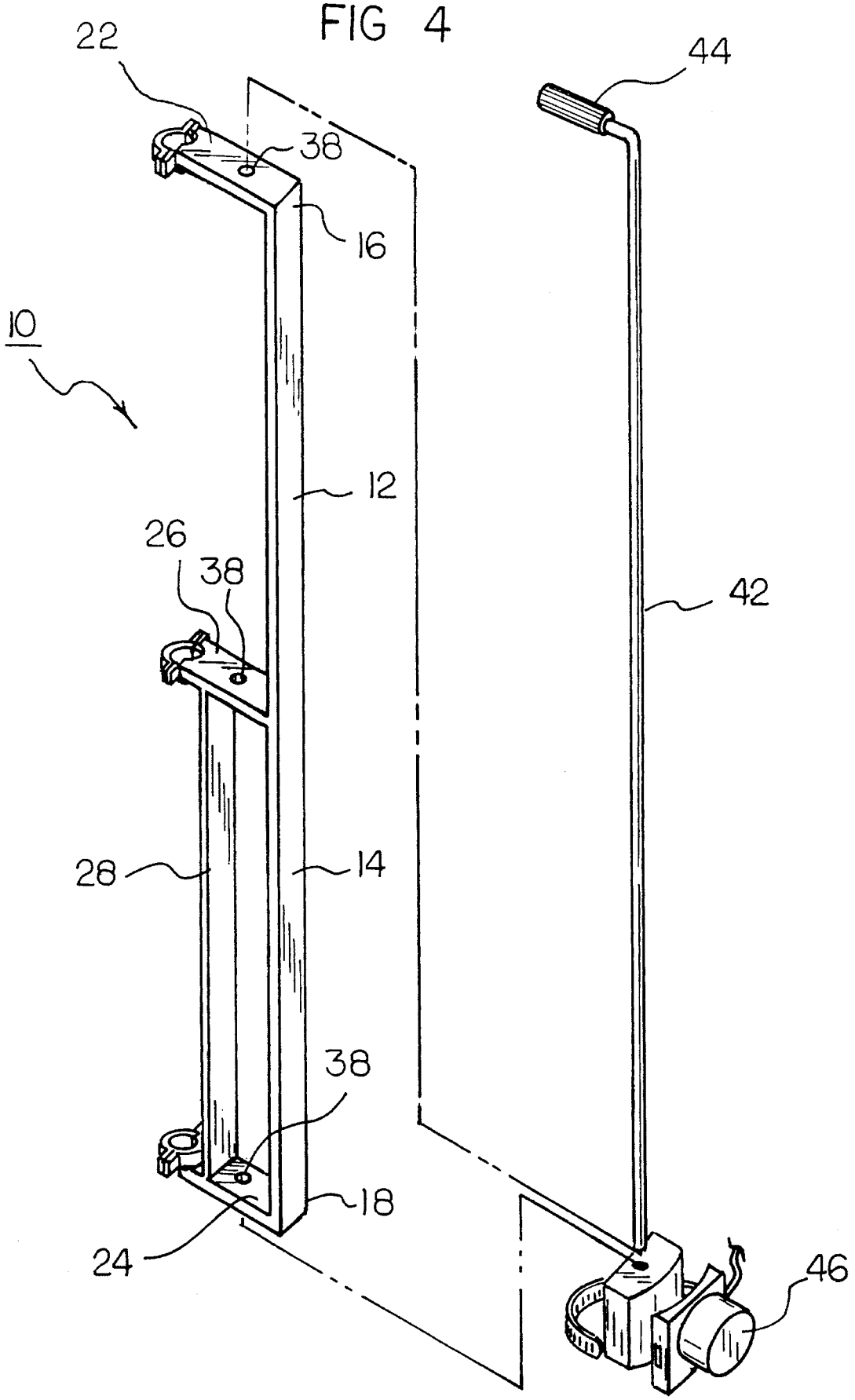
FIG. 4 is an exploded perspective view of the apparatus shown in the prior Figures.

With reference now to the drawings, and in particular to FIG. 1 thereof, a new and improved apparatus for supporting a depth finding transducer on a trolling motor for independent rotations embodying the principles and concepts of the present invention and generally designated by the reference numeral 10 will be described.

The present invention, the new and improved apparatus for supporting a depth finding transducer for rotation independent of a trolling motor is comprised of a plurality of individual components in a systems configuration. The components, in their broadest context, include a bracket, apertures through plates of the bracket, a rod through the apertures, bearing members between the rod and the bracket apertures and, in an alternate embodiment, a washer and finger assembly preclude inadvertent rotation between the rod and the bracket. The individual components are specifically configured and correlated one with respect to the other in order to attain the desired objective.

More specifically, the bracket 12 is adapted to be secured in a vertical orientation to front end of a boat, preferably a trolling boat. The bracket has an elongated end plate 14. Such an end plate has an upper end 16 above the water and a lower end 18 positionable beneath the water.

The bracket also has a horizontal upper plate 22 secured at a right angle from the upper end of the end plate. The bracket also has a horizontal lower plate 24 secured at a right angle from the lower end of the end plate. In addition, the bracket also has a horizontal intermediate plate 26 secured at a right angle from an intermediate location of the end plate between the upper end lower horizontal plates. A supplemental support plate 28 is preferably positioned in a vertical orientation between the lower and intermediate plates adjacent to the collars 30. Such support plate 28 increases the stability of the bracket.

Next provided are a plurality of collars 30. Each of the collars is secured to the end of each horizontal plate at the end thereof removed from the end plate. The collars are in axial alignment and are adapted to be supported on a shaft 32. The shaft of a trolling motor in turn is adapted to turn a trolling motor 34 at the lower end of the shaft beneath the level of the water. The shaft 32 is secured directly to the collars 30 for rotating the shaft 32 and motor 34 independent of the rotation of the bracket 12, collars 30 and shaft 32. The bracket is preferably fixedly positioned with respect to the boat, and the shaft 32 is coupled to the upper collar 30.

More specifically, the lower extent of the shaft is thinner than the upper extent and is rotatable within the two lower collars through bearings for allowing the user to rotate the lower extent of the shaft and the motor with respect to the bracket.

Also formed in association with the bracket is an aperture 38 formed in each of the horizontal plates. Such apertures are located intermediate the collar of the associated plate and the end plate. The apertures are in axial alignment in a vertical orientation.

Extending through the apertures is a rod 42. The rod is rigid and of an elongated construction. It has a handle 44 formed at right angles from the rod in a horizontal orientation at the upper end of the rod. The handle is for rotating the rod. At the lower end of the rod is a depth finder transducer 46. The transducer is adapted to be repositioned with the rotation of the rod. Such movement of the rod and transducer is independent of the movement of the bracket and the trolling motor including its shaft.

Coupled between the rod and apertures are bearing members 50. The bearing members are secured to the rod and function to preclude axial movement of the rod with respect to the bracket. Such rotational movement independent of axial movement allows rotation of the rod and transducer in any intended orientation.

Figure 5:
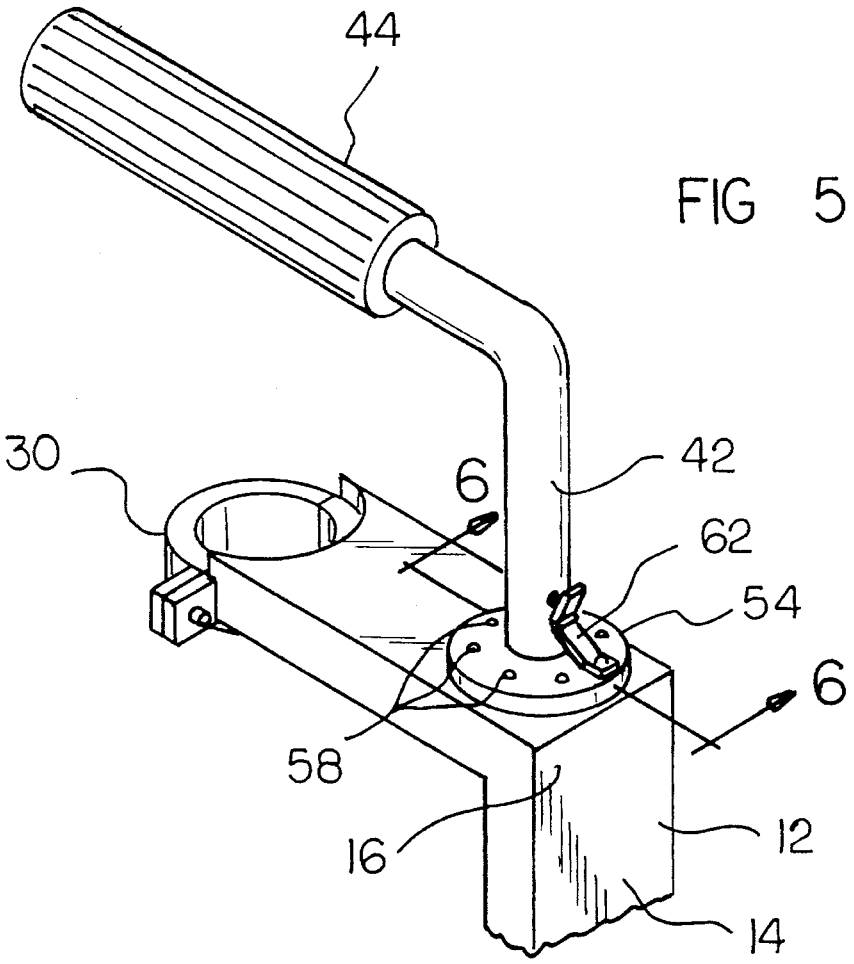
FIG. 5 illustrates the upper end of the bracket and rod constructed in accordance with an alternate embodiment of the present invention.
Figure 6:
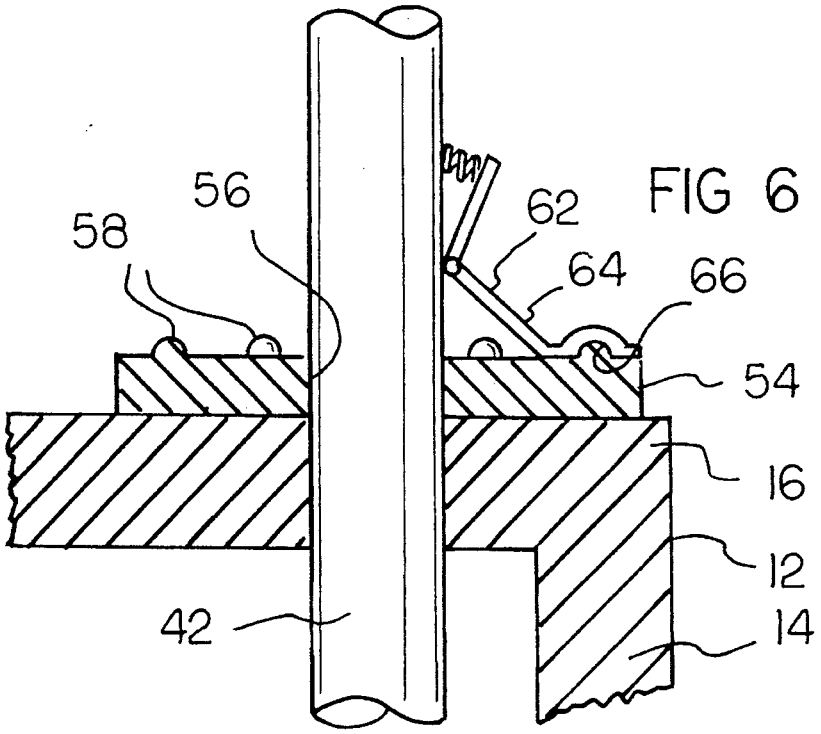
FIG. 6 is a sectional view taken along line 6—6 of FIG. 5.

The last aspect of the invention is shown in FIGS. 5 and 6. Such aspect is a device for insuring against inadvertent rotation of the rod with respect to the bracket. This is effected through a washer 54 secured to the upper surface of the upper horizontal plate. It has an aperture 56 co-extensive with the aperture of the upper horizontal plate. In addition, the washer has upwardly extending hemispherical projections 58. Such projections are oriented in a circumferential array.

Cooperable with the hemispherical projections is a spring urged finger 62 in an L-shaped configuration. The angle portion of the finger is pivotally secured to the rod above the collar. A spring urges one leg of the finger outwardly to pivot the longer leg 64 downwardly toward the collar. The longer leg is formed with a hemispherical shaped recess 66 adapted to receive a pre-selected hemispherical projection on the collar. With the finger and collar in coupled relationship through the hemispherical projection and recess, the action of the spring will tend to preclude inadvertent rotation of the rod with respect to the collar. Depressing the upper short leg of the finger against the action of the spring will raise the long leg of the finger to lift the hemispherical recess from the hemispherical projection whereby the handle may be used to rotate the rod and reposition the transducer. On properly positioned, the finger is released by the user to allow the hemispherical recess to engage the appropriate projection on the collar. In this manner, repositioning may be effected only through the deliberate action of the user without inadvertent rotation therebetween.

For the present invention, instead of putting the transducer on the motor of your trolling motor and having to turn the trolling motor where you want to see, my bracket stays stationary with transducer while turning trolling motor.

1. The mount attaches to the trolling motor's upper and lower shafts by three brackets.

2. The top bracket holds the mount stationary to the trolling motor's upper shaft.

3. The two lower brackets mount on the lower shaft of the trolling motor, allowing the lower shaft to rotate freely.

4. The mount has a directional rod running all the way through with a side shooting transducer mounted on the bottom.

5. Once the mount is installed on the trolling motor it allows you to rotate the transducer from side to side without turning the trolling motor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for supporting a depth finding transducer for rotation independent of a trolling motor comprising, in combination:

a bracket adapted to be secured to the front end of a boat, the bracket having a vertically disposal elongated end plate with an upper end positionable above the water and a lower end positionable beneath the water, the bracket having a horizontal upper plate secured at right angles from the upper end of the end plate, a horizontal lower plate secured at a right angle from the lower end of the end plate and a horizontal intermediate plate secured at a right angle from an intermediate position of the end plate;

a collar secured to the end of each horizontal plate remote from the end plate for mounting on a trolling motor shaft;

an aperture extending through each of the horizontal plates intermediate its collar and the end plate;

a rod extending through the apertures with a handle at its upper end for rotating the rod and a depth finding transducer at its lower end adapted to be repositioned with the rotation of the rod independent of movement of the trolling motor shaft;

bearing members coupled between the rod and the apertures to preclude axial movement of the rod while allowing rotation therebetween; and a washer secured to the upper surface of the upper horizontal plate with upstanding hemispherical projections oriented in a circumferential array and with a cooperable spring-urged resilient finger secured to the rod to effect a relative coupling between the rod and the upper horizontal plate to abate inadvertent rotation of the rod with respect to the washer.

2. An apparatus for supporting a depth finding transducer on a trolling motor for independent rotation comprising:

a bracket having an elongated end plate with an upper end and a lower end, the bracket having a horizontal upper plate secured at right angles adjacent to the upper end of the end plate and a horizontal lower plate secured at a right angle adjacent to the lower end of the end plate;

a collar secured to the end of each horizontal plate remote from the end plate for mounting on to a trolling motor shaft;

an aperture extending through each of the horizontal plates intermediate its collar and the end plate; and a rod extending through the apertures with a handle adjacent to its upper end for rotating the rod and a depth finding transducer at its lower end adapted to be repositioned with the rotation of the rod independent of movement of the trolling motor shaft.

3. The apparatus as set forth in claim 2 and further including:

a washer secured to the upper surface of the upper horizontal plate with upstanding hemispherical projections oriented in a circumferential array and with a cooperable spring-urged resilient finger secured to the rod to effect a relative coupling between the rod and the upper horizontal plate to abate inadvertent rotation of the rod with respect to the washer.

4. The apparatus as set forth in claim 2 and further including:

a horizontal intermediate plate secured at a right angle from an intermediate position of the end plate with a collar secured to the end thereof from the end plate.

5. The apparatus as set forth in claim 3 and further including:

an intermediate plate with a collar, the intermediate plate being located between the upper and lower plates and further including a vertical support plate between the intermediate and lower plates adjacent to their collars.

* * * * *